US005636742A

United States Patent [19]

Hoffrichter

[11] Patent Number: 5,636,742

[45] Date of Patent: Jun. 10, 1997

[54] CASE FOR PERSONAL USE

[75] Inventor: Thomas Hoffrichter, Parana, Brazil

[73] Assignee: Phimaplan Industria e Comercio de Materiais Plasticos LTDA, Parana, Brazil

[21] Appl. No.: 497,428

[22] Filed: Jun. 30, 1995

[30] Foreign Application Priority Data

Aug. 26, 1994 [BR] Brazil ..... 7401412.9

[51] Int. Cl.[6] ..... A45C 1/00

[52] U.S. Cl. ..... 206/494; 206/37; 383/41; 383/61; 383/93; 150/149

[58] Field of Search ..... 206/37, 38, 39, 206/215, 494, 812, 209, 449; 150/118, 131, 149; 383/61, 66, 84, 86, 93, 98, 99, 41

[56] References Cited

U.S. PATENT DOCUMENTS

| | | | |
|---|---|---|---|
| 2,658,544 | 11/1953 | Osaka | 206/38 |
| 2,826,230 | 3/1958 | Conell | 206/494 |
| 4,286,639 | 9/1981 | Murphy | 206/37 |
| 4,739,809 | 4/1988 | Adams | 150/118 X |
| 4,979,613 | 12/1990 | McLaughlin et al. | 206/233 |

*Primary Examiner*—Jacob K. Ackun

*Attorney, Agent, or Firm*—Cushman, Darby & Cushman IP group of Pillsbury Madison & Sutro LLP

[57] ABSTRACT

A case is disclosed which is essentially a case with a cover that is designed to allow a user to remove the contents of the case one by one. A first flap encloses the material within the case and a second flap covers the opening that allows access to the contained material. The case is typically used to hold and distribute blocks of paper sheets, paper handkerchiefs, small plastic bags, and other material.

7 Claims, 1 Drawing Sheet

CASE FOR PERSONAL USE

BACKGROUND OF THE INVENTION

This invention relates to a case with a cover that is designed to allow a user to remove the contents of the case one by one. The contents of the case is currently expected to be blocks of paper sheets, paper handkerchiefs, facial tissue, small plastic bags, and other material.

It is one of the objects of this invention to provide users with a case that is both convenient and easy to use in that it has a cover for covering the material emerging from the case and yet allows easy access to the case's material.

It is another object of this invention to provide users with a case that is capable of being manufactured easily due to the folding of an inner flap and thereby securing the contents of the case.

It is another object of this invention to provide a case for personal use made of a thin and flexible material, preferably plastic, leather, or fabric, with a flat and preferably quadrangular format.

Other objects, features, and characteristics of the present invention will become more apparent upon consideration of the following description and the appended claims with reference to the accompanying drawings, all of which form a part of this specification.

DETAILED DESCRIPTION OF THE INVENTION

Figure 1:
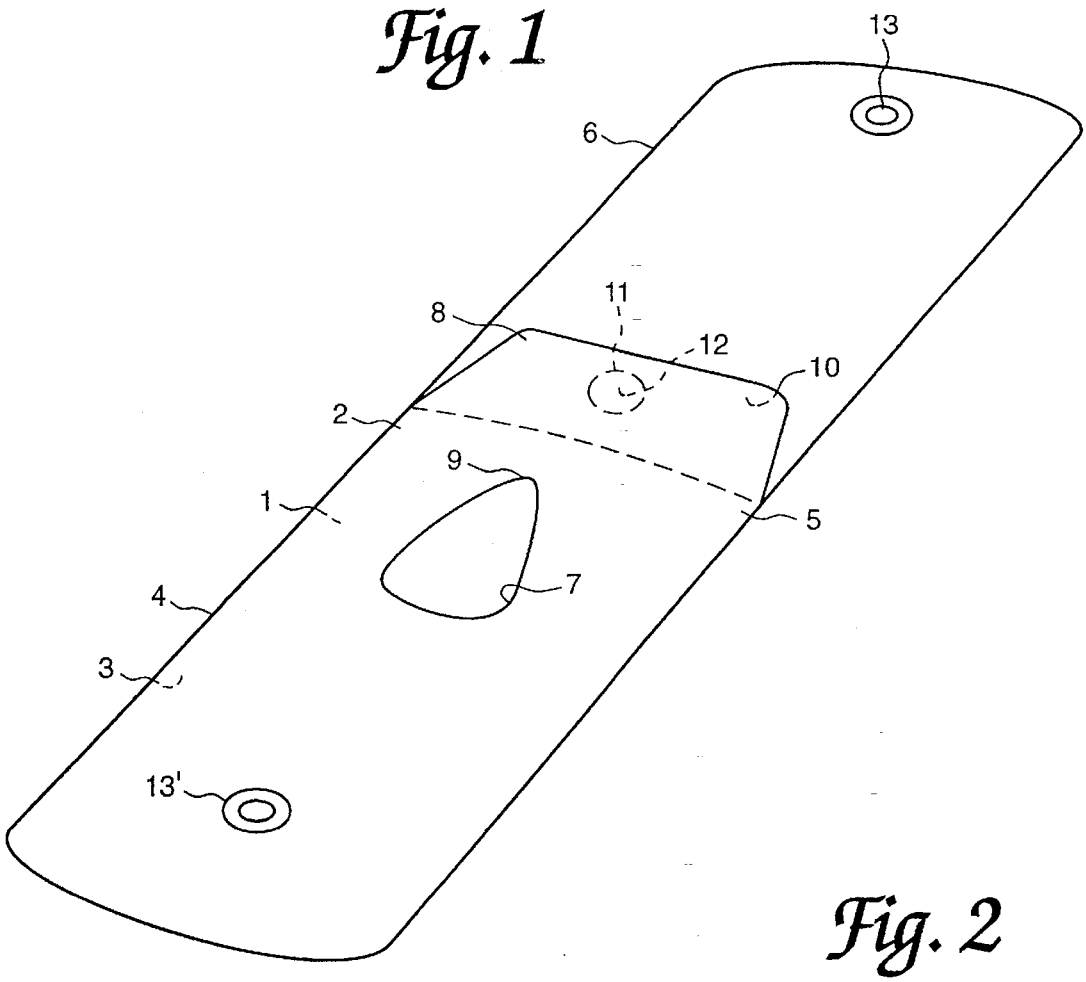
FIG. 1 is a perspective view of the case with the cover opened.

As shown in FIG. 1, a preferred embodiment of a case for personal use in accordance with the present invention is designated generally by the reference character 1. The case or bag 1 has a front side 2, a back side 3, an opening 7 on the front side 2, and an outer cover 6. In the invention depicted, the bag 1 is closed along the contour 4 of the bag 1 and open along the upper edge 5 of the bag 1 and this is represented by a dotted line in FIG. 1. As shown in FIG. 1, the bag 1 has a flexible and foldable inner cover 8 that has an inner side 10 and an outer side 12. A glued application 11 as an attaching device is created on the outer side 12 of the inner cover 8.

Figure 2:
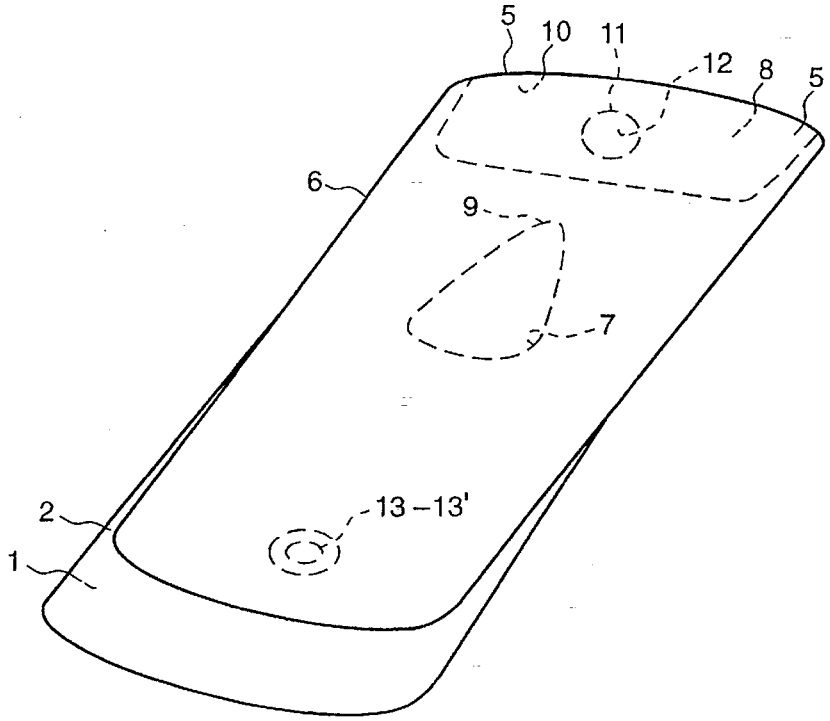
FIG. 2 is a perspective view of the case with the cover closed.

FIG. 2 depicts the inner cover 8 folded over, about the upper edge 5 of the bag 1, and the inner cover 8 extending almost to the upper edge 9 of the opening 7. FIG. 2 also shows the bag 1 with the outer cover 6 folded over, about the upper edge 5 of the bag 1. The outer cover 6 attaches to the front side 2 of the bag 1 by way of any appropriate means of reciprocal attachment. In FIG. 1, a pressure button 13 is shown but any reciprocal attachment will suffice. The pressure button 13 attaches to the pressure button's receiver 13'. This attachment between the pressure button 13 and the pressure button's receiver 13' is shown in FIG. 2.

The opening 7 is contoured to allow the user to remove the content of the case one by one and the contents can include such items as blocks of paper sheets, paper handkerchiefs, facial tissues, small plastic bags, or other items. The inner cover 8 allows one easily to insert these types of materials into the bag 1 and thereby provides for ease of use and manufacture of the depicted invention. Once it is folded inwards into the bag 1, the inner cover 8 also protects the upper edge of the material.

While the invention has been described in connection with what is presently considered to be the most practical and preferred embodiment, it is to be understood that the invention is not to be limited to the disclosed embodiment. The invention is intended to cover various modifications and equivalent arrangements included within the spirit and scope of the appended claims.

Thus, it is to be understood that variations in the particular elements, configuration, and materials employed can be made without departing from the novel aspects of this invention as defined in the claims.

I claim:

1. A case comprising:

a bag comprising an inside and an outside wherein the outside of the bag comprises a front side and a back side;

an opening on the front side of the bag;

a first cover attached to the front side of the bag that is capable of being folded over into the inside of the bag;

an attaching mechanism for attaching the first cover to the inside of the bag; and a second cover attached to the back side of the bag and capable of being folded over so as to cover the opening.

2. A case as claimed in claim 1 wherein the second cover further comprises a second attaching mechanism for attaching the second cover to the front side of the outside of the bag.

3. A case as claimed in claim 1 wherein the attaching mechanism is glue.

4. A case as claimed in claim 1 wherein the opening is substantially three-sided in shape.

5. A case as claimed in claim 1 wherein the bag is substantially quadrangular in shape.

6. A case as claimed in claim 1 wherein the bag is comprised of one of a plastic material, fabric material, and leather material.

7. A case comprising:

a bag comprising an inside and outside wherein the outside of the bag comprises a front side and a back side;

an opening on the front side of the bag;

a first cover attached to the front side of the bag that is capable of being folded over into the inside of the bag;

a first attachment mechanism on the first cover for attaching the first cover to the inside of the bag wherein said first attachment mechanism is glue;

a second cover located on the back side of the bag and capable of being folded over so as to cover the opening; and a second attachment mechanism for attaching the second cover to the front side of the outside of the bag.

* * * * *